US008584313B2

(12) United States Patent
Kim

(10) Patent No.: US 8,584,313 B2
(45) Date of Patent: Nov. 19, 2013

(54) VACUUM CLEANER

(75) Inventor: Young-Ho Kim, Changwon-si (KR)

(73) Assignee: LG Electronics Inc., Seoul (KR)

( * ) Notice: Subject to any disclaimer, the term of this patent is extended or adjusted under 35 U.S.C. 154(b) by 264 days.

(21) Appl. No.: 13/002,122

(22) PCT Filed: Apr. 29, 2009

(86) PCT No.: PCT/KR2009/002271
§ 371 (c)(1),
(2), (4) Date: May 13, 2011

(87) PCT Pub. No.: WO2010/002098
PCT Pub. Date: Jan. 7, 2010

(65) Prior Publication Data

US 2011/0209303 A1 Sep. 1, 2011

(30) Foreign Application Priority Data

Jul. 2, 2008 (KR) ..... 10-2008-0063748

(51) Int. Cl.
*B24B 9/10* (2006.01)

(52) U.S. Cl.
USPC ..... 15/347; 15/352

(58) Field of Classification Search
USPC ..... 15/347, 352, 353, 327.1
See application file for complete search history.

(56) References Cited

U.S. PATENT DOCUMENTS

| | | | | |
|---|---|---|---|---|
| 7,958,598 | B2 * | 6/2011 | Yun et al. | 15/353 |
| 8,281,455 | B2 * | 10/2012 | Hwang et al. | 15/347 |
| 2009/0241286 | A1 * | 10/2009 | Hwang et al. | 15/347 |

FOREIGN PATENT DOCUMENTS

| | | | |
|---|---|---|---|
| JP | 2006-006383 | A | 1/2006 |
| JP | 2008-086617 | A | 4/2008 |
| KR | 10-2006-0107632 | A | 10/2006 |
| KR | 10-0800189 | B1 | 1/2008 |
| KR | 10-0838887 | B1 | 6/2008 |
| WO | WO 2008/070970 | A1 | 6/2008 |
| WO | WO 2008100005 | A1 * | 8/2008 |

OTHER PUBLICATIONS

Russian Office Action dated Jun. 3, 2012 issued in Application No. 2011101938/12 (with English translation).
PCT International Search Report dated Nov. 20, 2010 issued in Application No. PCT/KR2009/002271.

* cited by examiner

*Primary Examiner* — Dung Van Nguyen
(74) *Attorney, Agent, or Firm* — KED & Associates, LLP

(57) ABSTRACT

A vacuum cleaner is provided. The vacuum cleaner includes a cleaner body including a suction motor, a dust separation device communicated with the cleaner body, the dust separation device separating dusts, a dust container separably mounted on the cleaner body, the dust container including a dust storage part storing the dusts separated by the dust separation device, a compressing member compressing the dusts stored in the dust storage part, a magnetic member seat part disposed at the dust container, a magnetic member seated on the magnetic member seat part, a cover coupled to the magnetic member seat part to cover the magnetic member, and a magnetism detection unit disposed at the cleaner body to detect magnetism of the magnetic member.

10 Claims, 24 Drawing Sheets

VACUUM CLEANER

TECHNICAL FIELD

Embodiments relate to a vacuum cleaner.

BACKGROUND ART

In general, vacuum cleaners are apparatuses in which air containing dusts is sucked using a suction force generated by a suction motor mounted within a cleaner body to filter the dusts in a dust separation device.

Such a vacuum cleaner may be largely classified into a canister type in which a suction nozzle is separated from a main body to connect thereto through a connection tube and an upright type in which a suction nozzle is coupled to a main body.

DISCLOSURE

Technical Problem

Embodiments provide a vacuum cleaner improving dust collection capacity.

Embodiments also provide a vacuum cleaner in which a dust empty time is displayed on the outside when a predetermined amount or more of dust is collected in a dust container.

Technical Solution

In one embodiment, a vacuum cleaner includes: a cleaner body including a suction motor; a dust separation device communicated with the cleaner body, the dust separation device separating dusts; a dust container separably mounted on the cleaner body, the dust container including a dust storage part storing the dusts separated by the dust separation device; a compressing member compressing the dusts stored in the dust storage part; a magnetic member seat part disposed at the dust container; a magnetic member seated on the magnetic member seat part; a cover coupled to the magnetic member seat part to cover the magnetic member; and a magnetism detection unit disposed at the cleaner body to detect magnetism of the magnetic member.

Advantages Effects

According to the proposed embodiment, when the suction motor operation signal is inputted in a state where the dust container is not mounted, these states may be informed to the outside to prevent the suction motor or the compressing motor from being unnecessarily operated.

Also, since the dusts stored in the dust container are compressed to minimize a volume of the dusts, the dusts capacity storable in the dust container may be maximized.

Also, since the dust collection capacity of the dust container is maximized, an inconvenience in which the dusts stored in the dust container are frequently emptied may be removed.

Also, when the dusts are collected in the dust container beyond a predetermined amount, the dust emptying time may be displayed to allow the user to easily recognize the dust emptying time.

MODE FOR INVENTION

Reference will now be made in detail to the embodiments of the present disclosure, examples of which are illustrated in the accompanying drawings.

Figure 1:
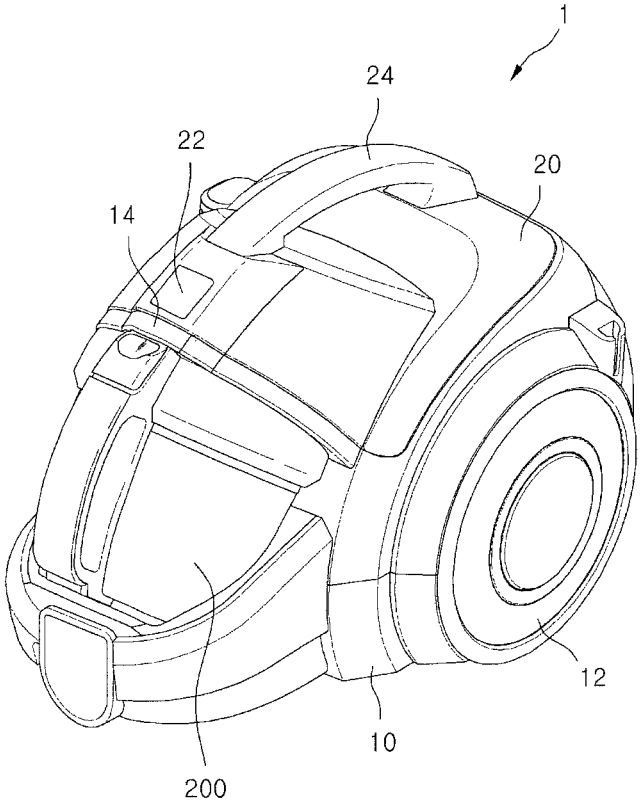
FIG. 1 is a perspective view of a vacuum cleaner including a dust separation device according to an embodiment.
Figure 2:
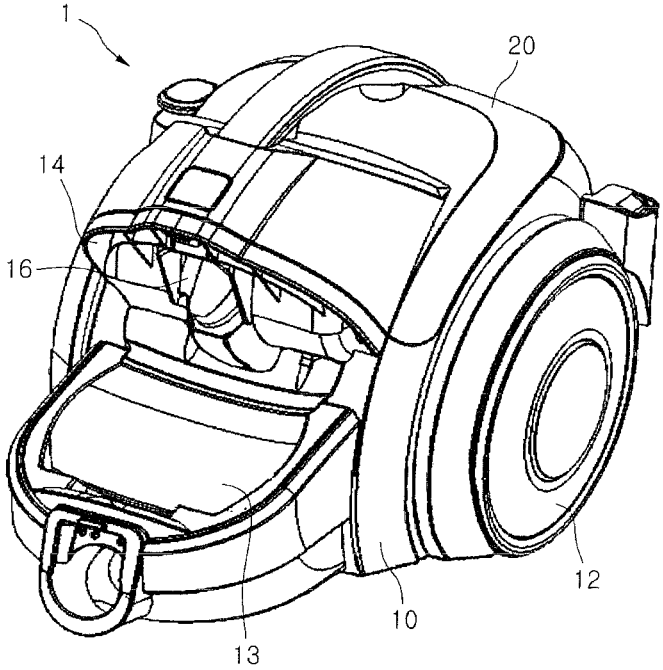
FIG. 2 is a perspective view of a vacuum cleaner with a dust container separated.
Figure 3:
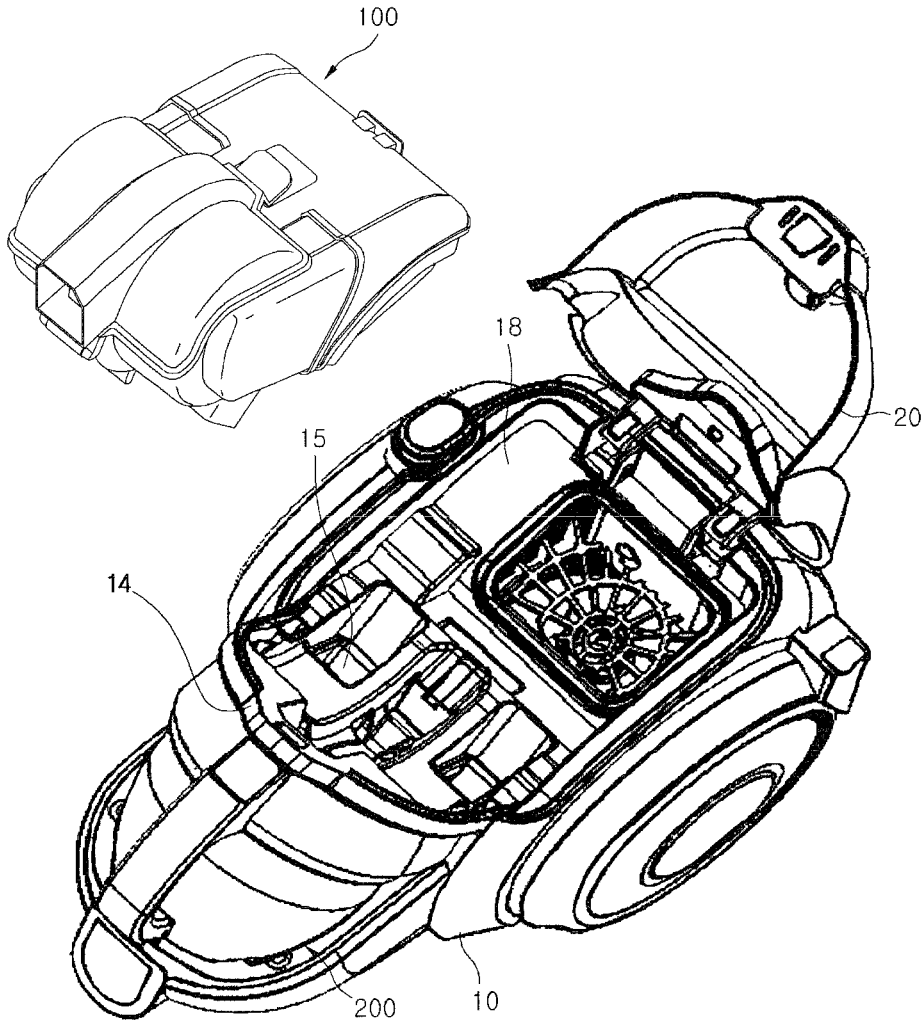
FIG. 3 is a perspective view of a vacuum cleaner with a dust separation device separated.

FIG. 1 is a perspective view of a vacuum cleaner including a dust separation device according to an embodiment. FIG. 2 is a perspective view of a vacuum cleaner with a dust container separated. FIG. 3 is a perspective view of a vacuum cleaner with a dust separation device separated.

Referring to FIGS. 1 to 3, a vacuum cleaner 1 according to the current embodiment includes a cleaner body 10 in which a suction motor is built, a dust separation device 100 separably mounted on the cleaner body 10 and separating dusts from air, and a dust container 200 separably mounted on the cleaner body 10 and storing the dusts separated by the dust separation device 100.

In detail, a plurality of wheels 12 for easily moving the cleaner body 10 is disposed on the cleaner body 10. A dust container mounting part 13 is disposed on the cleaner body 10 to mount the dust container 200. A fixing plate 14 for fixing the dust container 200 is disposed above the dust container mounting part 13. A receiving part 18 for receiving the dust separation device 100 is disposed at an upper portion of the cleaner body 10. A cover 20 for covering the dust separation device 100 in a state where the dust separation device 100 is received into the receiving part 18 is disposed on the cleaner body 10. The cover 20 has one end rotatably coupled to the cleaner body 10 by a hinge and the other end separably coupled to the fixing plate 14. A coupling button 22 is disposed on the cover 20 to couple the cover 20 to the fixing plate 14. An end of the coupling button 22 is selectively hung on the fixing plate 14.

A portion of the dust separation device 100 is seated on the fixing plate 14 in a state where the dust separation device 100 is received into the receiving part 18. An opening 16 for moving dusts separated by the dust separation device 100 into the dust container 200 is defined in the fixing plate 14. The opening 16 communicates with a dust discharge part (that will be described later) of the dust separation device 100. A plurality of suction holes 15 for introducing air containing dusts into the dust separation device 100 is defined in the fixing plate 14. For example, two suction holes 15 are defined in FIG. 3.

Figure 4:
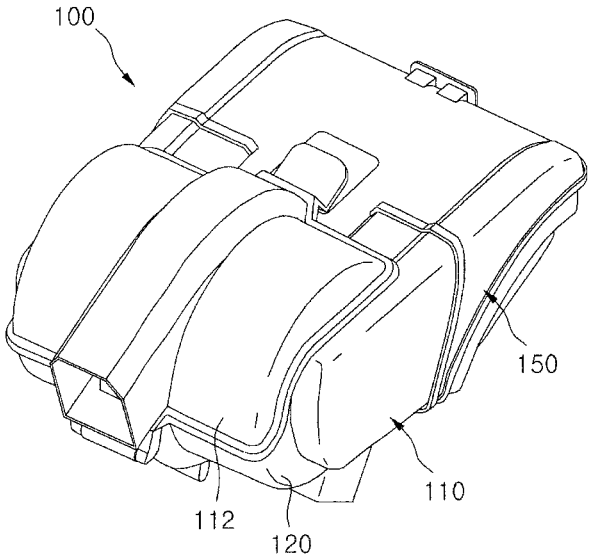
FIG. 4 is a perspective view of a dust separation device according to an embodiment.

FIG. 4 is a perspective view of a dust separation device according to an embodiment.

Figure 5:
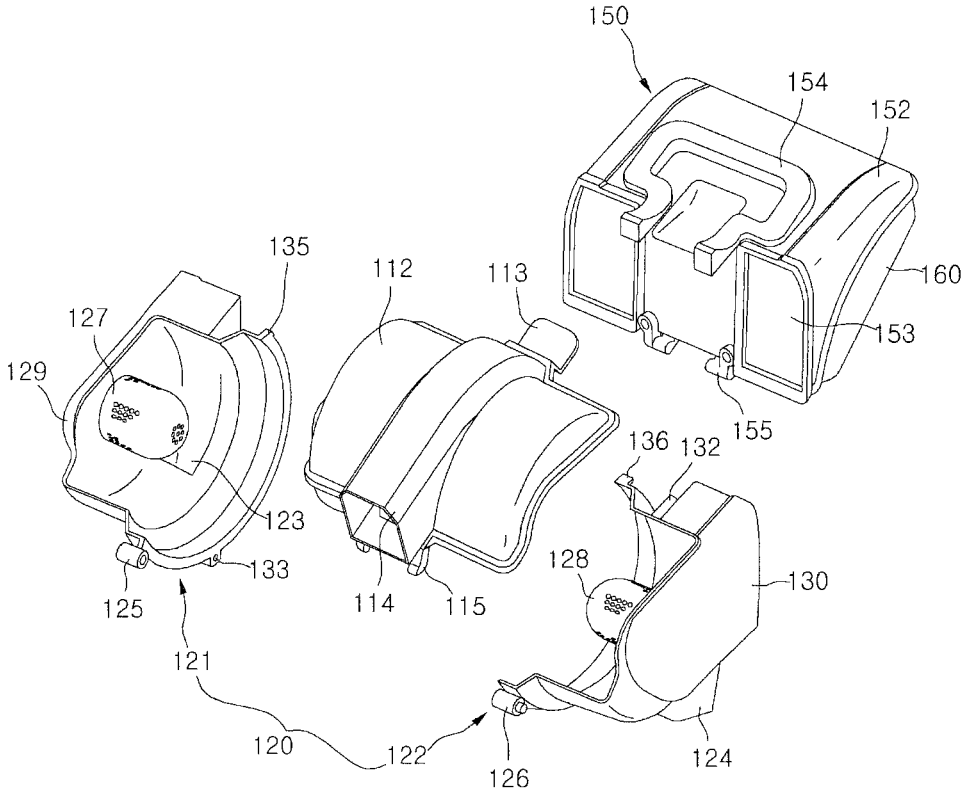
FIG. 5 is an exploded perspective view of the dust separation device.
Figure 6:
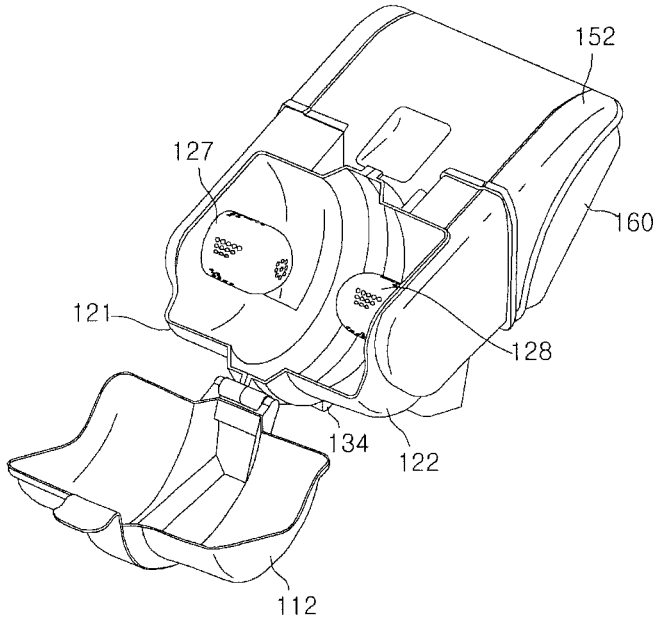
FIG. 6 is a perspective view of a dust separation device in a state where a first main body is rotated.

FIG. 5 is an exploded perspective view of the dust separation device. FIG. 6 is a perspective view of a dust separation device in a state where a first main body is rotated.

Referring to FIGS. 4 to 6, the dust separation device 100 includes a dust separation unit 110 for separating dusts from air and a filter unit 150 coupled to the side of the dust separation unit 110 to filter air discharged from the dust separation unit 110.

The dust separation unit 110 separates dusts from air using a cyclone flow. The dust separation unit 110 includes a first main body 112 and a second main body 120 rotatably coupled to the first main body 112. The second main body 120 includes a first sub body 121 and a second sub body 122 having a shape corresponding to that of the first sub body 121 and coupled to the first sub body 121. That is, in the current embodiment, the dust separation unit 110 is coupled to the plurality of bodies to realize a complete configuration.

A dust discharge part 114 through which the dusts separated from the air are discharged is disposed in the first main body 112. A coupling lever 113 for coupling the second main body 120 is disposed on the first main body 112. A pair of hinges 115 for rotatably coupling the second main body 120 is disposed on the first main body 112. Suction parts 123 and 124 for sucking air and dusts are disposed in the first sub body 121 and the second sub body 122, respectively. That is, the dust separation unit 110 includes the plurality of suction parts 123 and 124. Each of the suction parts 123 and 124 extends in a tangential direction of each of the first and second sub bodies 121 and 122 to generate the cyclone flow. Also, hinge coupling parts 125 and 126 to which the pair of hinges 115 is coupled is disposed on the first and second sub bodies 121 and 122, respectively. Also, discharge holes (see reference numerals 137 and 138 of FIG. 9) through which the air separated from the dusts is discharged are defined in the first and second sub bodies 121 and 122, respectively. Also, filter bodies 127 and 128 for filtering the air are coupled to surfaces in which the discharge holes (see reference numerals 137 and 138 of FIG. 9) are defined, respectively.

Air discharge parts 129 and 130 for moving the air passing through the discharge holes (see reference numerals 137 and 138 of FIG. 9) into the filter unit 150 are disposed on the first and second sub bodies 121 and 122, respectively. Also, coupling parts 133 and 134 to which a screw is coupled to couple them to each other and a coupling boss 132 for coupling the filter unit 150 are disposed on the first and second sub bodies 121 and 122. Also, coupling ribs 135 and 136 for coupling the coupling lever 113 of the first main body 112 are disposed the first and second sub bodies, respectively.

Figure 7:
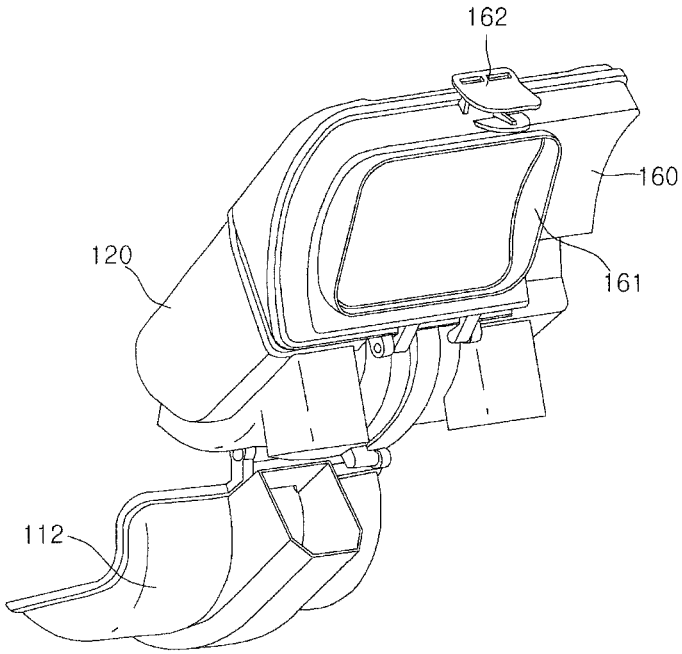
FIG. 7 is a bottom perspective view of the dust separation device in the state where the first main body is rotated.
Figure 8:
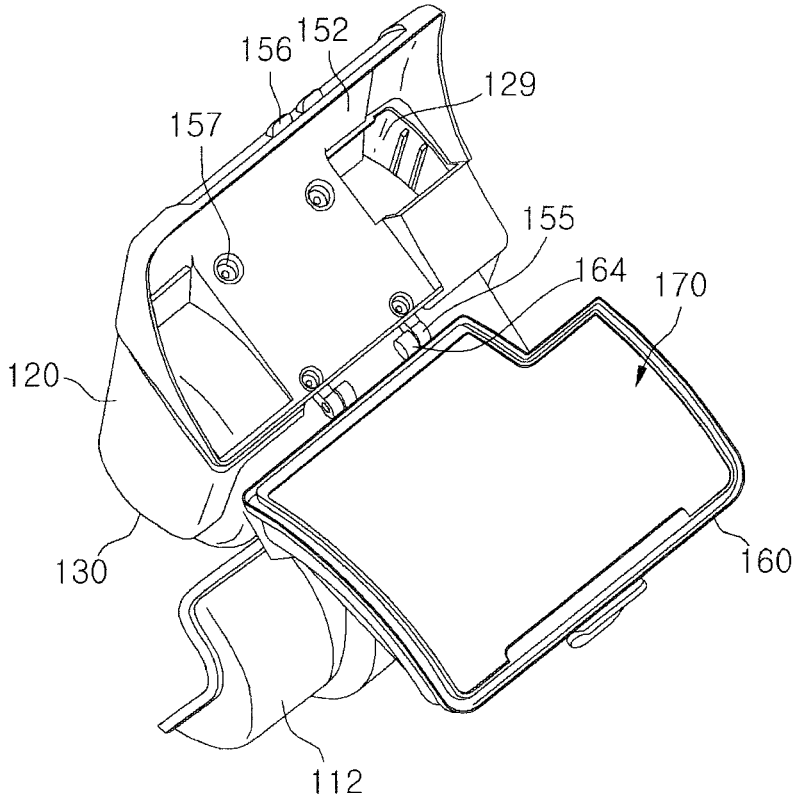
FIG. 8 is a bottom perspective view of the dust separation device in a state where a second case constituting a filter unit in FIG. 7 is rotated.
Figure 9:
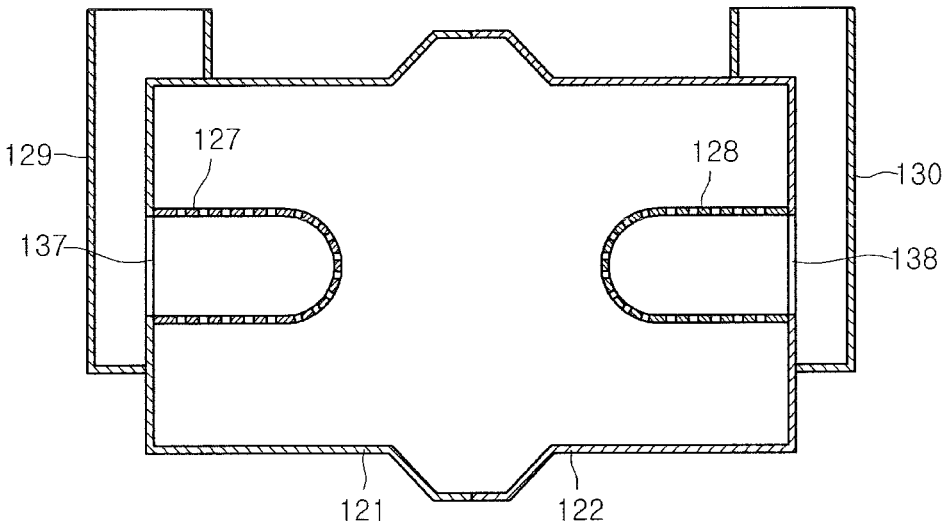
FIG. 9 is a sectional view of a dust separation unit according to an embodiment.

FIG. 7 is a bottom perspective view of the dust separation device in the state where the first main body is rotated. FIG. 8 is a bottom perspective view of the dust separation device in a state where a second case constituting a filter unit in FIG. 7 is rotated. FIG. 9 is a sectional view of a dust separation unit according to an embodiment.

Referring to FIGS. 4 to 9, the filter unit 150 includes a first case 152 coupled to the dust separation unit 110, a second case 160 rotatably coupled to the first case 152, and a filter 170 seated on the second case 160. In detail, a pair of openings 153 through the air discharged from the air discharge parts 129 and 130 is introduced is defined in the first case 152. Also, a handle 154 grasped by a user is disposed on the first case 152. A pair of hinge coupling parts 155 coupled to a pair of hinges 164 of the second case 160 is disposed at a lower portion of the first case 152. Also, a coupling protrusion 156 for selectively coupling the coupling lever 162 of the second case 160 is disposed on the first case 152. A plurality of coupling holes 157 to which the screw is coupled is defined in the first case 152. Thus, when the screw is coupled to the plurality of coupling holes 157, the screw is coupled to the coupling boss 132 of the dust separation unit 110 to couple the filter unit 150 to the dust separation unit 110. A discharge hole 161 through which the air passing through the filter 170 is defined in the second case 160. Since the dust separation unit 110 and the filter unit 150 are coupled to each other, when the user lifts the filter unit 150 in a state where the user grasps the handle 154, the dust separation unit 110 and the filter unit 150 are withdrawn from the cleaner body 10 at the same time.

Hereinafter, an effect of the dust separation unit 100 will be described.

Air containing dusts is sucked into the dust separation unit 110 through the pair of suction parts 123 and 124. Thus, since the air passing through the suction parts 123 and 124 is sucked into the dust separation unit 110, a pair of cyclone flows corresponding to each other is formed inside the dust separation unit 110.

The air sucked into the dust separation unit 110 is rotated along an inner circumference surface of the dust separation unit 110 and is concentrated into a center of the dust separation unit 110. In this process, the air and the dusts are separated from each other by centrifugal forces different from each other due to a weight difference therebetween. The separated dusts are discharged through the dust discharge part 114 at the center of the dust separation unit 110. Then, the discharged dusts are moved along the dust discharge part 114 and introduced into the dust container 200. On the other hand, the air separated from the dusts passes through the filter bodies 127 and 128 and are moved into the air discharge parts 129 and 130 through the discharge holes 137 and 138. The air discharged into the air discharge parts 129 and 130 is moved into the filter unit 150.

Figure 10:
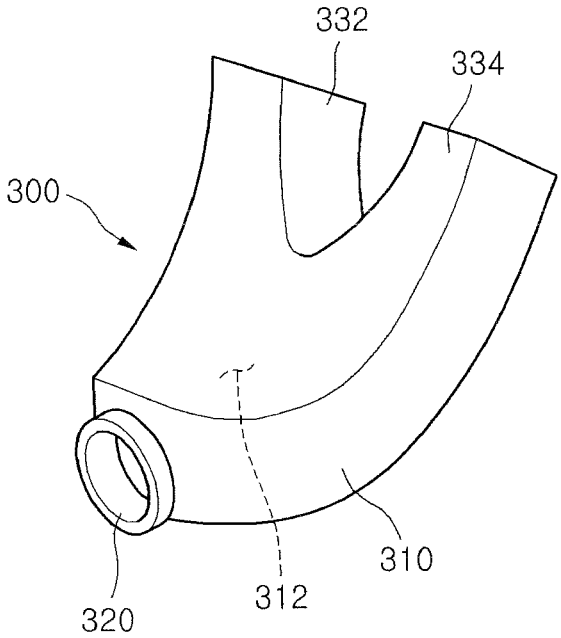
FIG. 10 is a perspective view of a distribution unit according to an embodiment.

FIG. 10 is a perspective view of a distribution unit according to an embodiment.

Referring to FIG. 10, the distribution unit 300 according to the current embodiment distributes air introduced into the cleaner body 10 into the dust separation device 100. The distribution unit 300 is disposed inside the cleaner body 10.

The distribution unit 300 includes a body 310 in which a main passage is defined therein, a suction hole 320 for sucking the air containing dusts into the body 310, and a pair of branch parts 332 and 334 in which the air introduced into the body 310 is divided. Thus, the air introduced into the main passage through the suction hole 320 is moved into each of the suction parts 123 and 124 of the dust separation unit 110 in a state where the air is divided by the branch parts 332 and 334.

Figure 11:
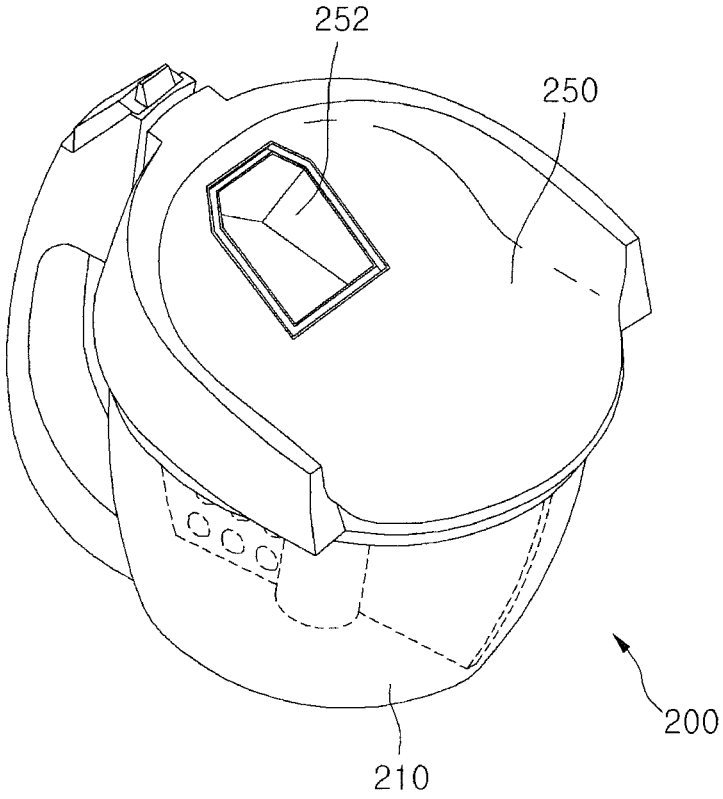
FIG. 11 is a perspective view of a dust container according to an embodiment.
Figure 12:
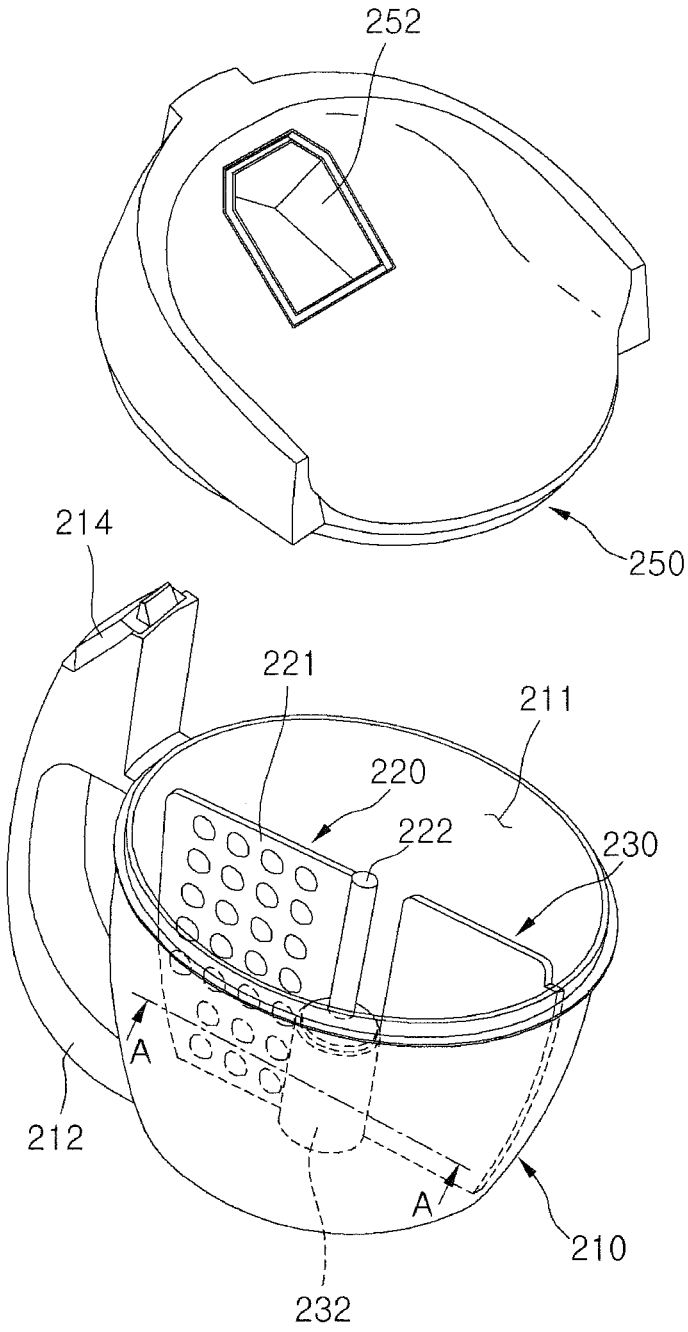
FIG. 12 is an exploded perspective view of the dust container.
Figure 13:
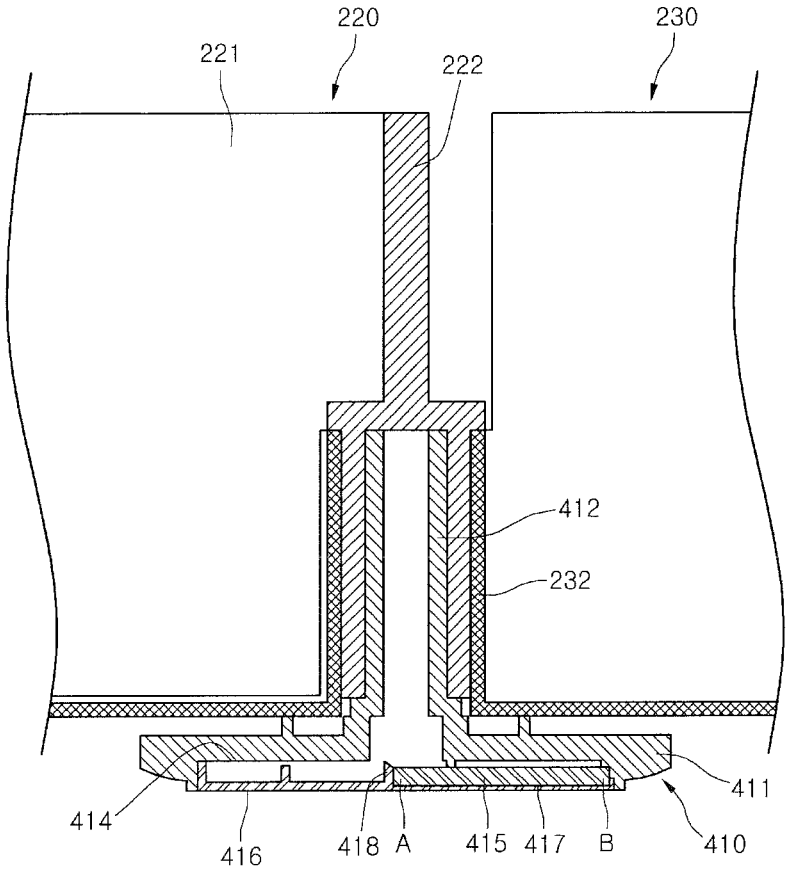
FIG. 13 is a sectional view taken along line A-A of FIG. 12.
Figure 14:
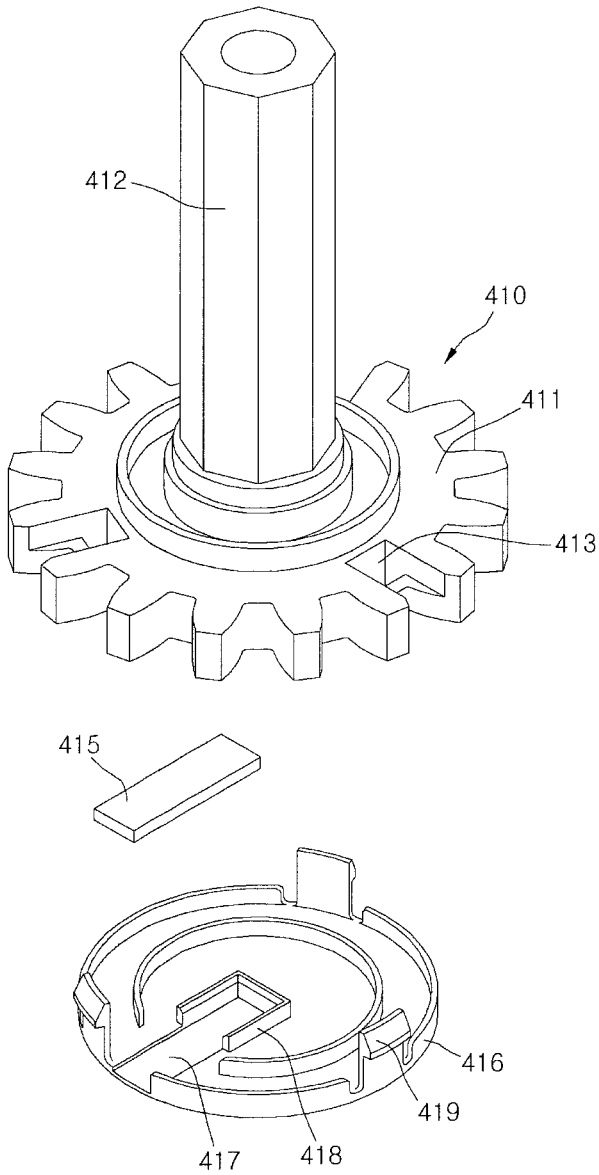
FIG. 14 is an exploded perspective view of a driven gear according to an embodiment.
Figure 15:
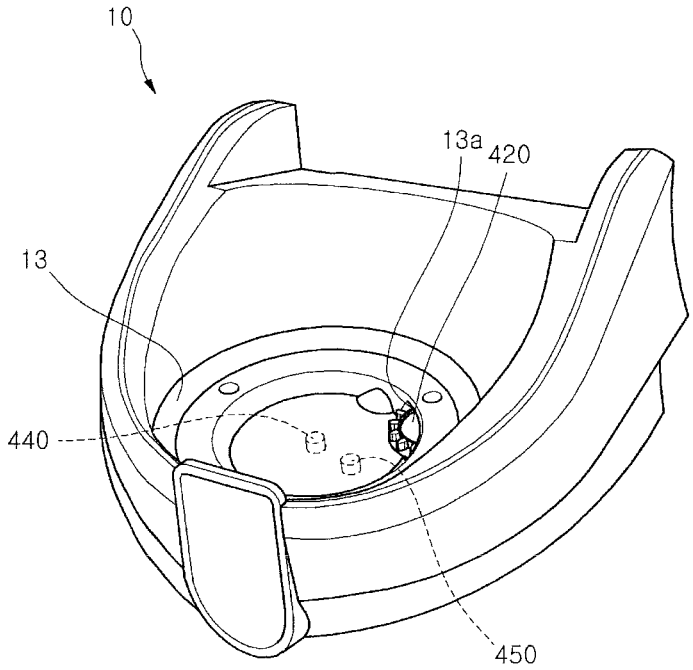
FIG. 15 is a perspective view of a mounting part according to an embodiment.

FIG. 11 is a perspective view of a dust container according to an embodiment. FIG. 12 is an exploded perspective view of the dust container. FIG. 13 is a sectional view taken along line A-A of FIG. 12. FIG. 14 is an exploded perspective view of a driven gear according to an embodiment. FIG. 15 is a perspective view of a mounting part according to an embodiment.

Referring to FIGS. 11 to 15, the dust container 200 includes a dust collection body 210 in which a dust storage part 211 for storing the dusts is disposed and a cover member 250 coupled to an upper portion of the dust collection body 210.

In detail, a handle 212 grasped by the user is disposed on the dust collection body 210. A coupling lever 214 selectively coupled to the fixing plate 14 is dispose on the handle 212. A dust inflow part 252 through which the dust separated by the dust separation device 100 is introduced is disposed in the cover member 250. The dust inflow part 252 communicates with the opening 16 of the fixing plate 14.

A plurality of compressing members for compressing the dusts stored in the dust storage part 211 is disposed inside the dust collection body 210. The plurality of compressing members includes a first compressing member 220 rotatably coupled to the dust collection body 210 and a second compressing member 230 integrated with the dust collection body 210. The second compressing member 230 is integrated with a fixed shaft 232 protruding upward from a bottom surface of the dust collection body 210. The first compressing member 220 includes a compressing plate 221 for compressing the dusts by an interaction with the second compressing member 230 and a rotating shaft 222 integrated with the compressing plate 221. The rotating shaft 222 is coupled to the fixed shaft 232.

The first compressing member 220 is rotated by a driving device. In detail, the driving device includes a driving source for generating a driving force and power transmission parts 410 and 420 for transmitting the driving force of the driving source into the first compressing member 220. A compressing motor may be applied as the driving source. The power transmission parts 410 and 420 includes a driven gear coupled to the rotating shaft of the first compressing member 220 and a driving gear 420 for transmitting a driving force of the compressing motor into the driven gear 410. The driving gear 420 is coupled to the rotating shaft of the compressing motor and rotated by the compressing motor.

In detail, the driven gear 410 includes a gear body 411 on which a plurality of gear tooth is disposed, a gear shaft 412 vertically extending in an upward direction of the gear body 411, and a cover 416 on which a magnetic member 415 is seated and coupled to a lower portion of the gear body 411. The gear shaft 412 of the driven gear 410 is coupled to the rotating shaft 222 of the first compressing member 220 at a lower side of the dust collection body 210. As described above, since the gear shaft 412 of the driven gear 410 is coupled to the rotating shaft 222 of the first compressing member 220 at the lower side of the dust collection body 210, the driven gear 410 is exposed to the outside of the dust collection body 210. Also, a receiving part 414 for receiving the cover 416 in a state where the cover 416 is coupled is disposed under the gear body 411. A bottom surface of the gear body 411 is recessed upward to form the receiving part 414. A plurality of hook coupling holes 413 to which a plurality of hooks spaced from each other along a circumference of the cover 416 is coupled is defined in the gear body 411.

The magnetic member 415 has a rectangular rod shape. A seat groove 417 on which the magnetic member 415 is seated is recessed in a shape corresponding to that of the magnetic member 415 into the cover 416. The seat groove 417 extends from a center of the cover 416 in a radius direction. A guide rib 418 for guiding a position of the magnetic member 415 is disposed on a portion of a circumference of the seat groove 417. The cover 416 is coupled to a lower portion of the gear body 411 in a state where the magnetic member 415 is seated on the cover 416. Thus, when the gear body 411 is rotated, the magnetic member 415 is rotated together with the gear body 411.

In the current embodiment, since the cover 416 is coupled to the driven gear 410 and fixed in position in a state where the magnetic member 415 is seated on the cover 416, this may be described as that the magnetic member 415 is seated on the driven gear 410. Thus, the driven gear 410 may be referred to as a magnetic member seat part. In this case, it may be described as that the cover 416 covers the magnetic member 415 in a state where the magnetic member 415 is seated on the magnetic member seat part.

The compressing motor is disposed inside the dust container mounting part 13. The driven gear 420 is coupled to a shaft of the compressing motor and is disposed on a bottom surface of the dust container mounting part 13. A portion of an outer surface of the driven gear 420 is exposed to the outside on the bottom surface of the dust container mounting part 13. An opening 13*a* for exposing the portion of the outer surface of the driven gear 420 to the dust container mounting part 13 is defined in the bottom surface of the dust container mounting part 13. Thus, since the driven gear 420 is exposed to the dust container mounting part 13, when the dust container 200 is mounted on the dust container mounting part 13, the driven gear 410 is engaged with the driving gear 420. Here, a reversible motor may be used as the compressing motor.

Thus, the first compressing member 220 may be forwardly (clockwise direction (rotation)) and reversely (counter-clockwise direction (rotation)) rotated. Since the first compressing member 220 is forwardly and reversely rotated, the compressed dusts are collected on both sides of the second compressing member 230. As described above, for the forward and reverse rotation of the compressing motor, a synchronous motor may be used as the compressing motor.

A plurality of magnetism detection units for detecting magnetism generated from the magnetic member 415 is disposed inside the dust container mounting part 13. In detail, each of the magnetism detection units includes a first magnetism detection unit 440 for detecting the mounting of the dust container 200 and a second magnetism detection unit 450 for detecting the position of the driven gear 410 or the position of the first compressing member 220. A hall sensor may be applied to each of the magnetism detection units 440 and 450.

The first magnetism detection unit 440 is disposed at a center of the dust container mounting part 13 to detect magnetism of one end A of the magnetic member 415. Also, the second magnetism detection unit 450 is disposed spaced from the first magnetism detection unit 440 to detect magnetism of the other end B of the magnetic member 415. Here, for allowing the second magnetism detection unit 450 to effectively detect the magnetism generated from the magnetic member 415, the second magnetism detection unit 450 may be disposed directly below a locus drawn by the magnetic member 415 when the driven gear 410 is rotated in a state where the dust container 200 is mounted on the dust container mounting part 13. Thus, when the magnetic member 415 is mounted on the dust container mounting part 13, the first magnetism detection unit 440 may detect always the magnetism. On the other hand, in a process in which the driven gear 410 is rotated, the second magnetism detection unit 450 detects the magnetism of the magnetic member 415 only when the magnetic member 415 is disposed above the second magnetism detection unit 450. Thus, whether the driven gear 410 or the first compressing member 220 is rotated may be confirmed. Detailed description with respect to this will be described below.

Figure 16:
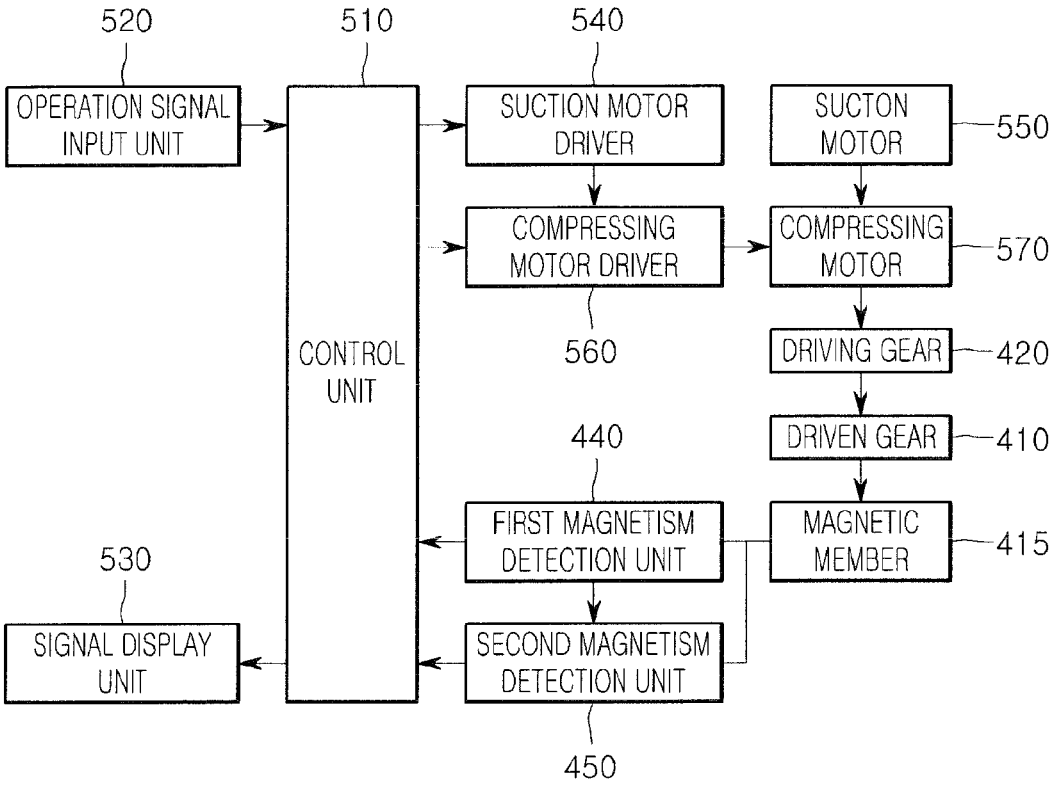
FIG. 16 is a block diagram illustrating a control unit of a vacuum cleaner according to an embodiment.

FIG. 16 is a block diagram illustrating a control unit of a vacuum cleaner according to an embodiment.

Referring to FIG. 16, the vacuum cleaner according to the current embodiment includes a control unit 510, an operation signal input unit 520 selecting a suction power (e.g., strong, medium, and weak mode), a signal display unit 530 displaying a dust emptying signal of dusts stored in the dust container 200 and a dust container non-mounting signal, a suction motor driver 540 for operating a suction motor 550 according to an operation mode inputted from the operation signal input unit 520, a compressing motor driver 560 for operating the compressing motor 570, a driving gear 420 operated by the compressing motor 570, a driven gear 410 rotated by being engaged with the driving gear 420, a magnetic member 415 disposed on the driven gear 410, and first and second detection units 440 and 450 for detecting magnetism of the magnetic member 415.

In detail, when the dust container 200 is not mounted on the dust container mounting part 13, the magnetism of the magnetic member 415 is not detected by the first magnetism detection unit 440. Thus, in this state, when an operation signal is inputted from the operation signal input unit 520, the control unit 510 controls the signal display unit 530 to display a dust container non-mounting signal on the signal display unit 530. The control unit 510 determines an amount of dusts stored in the duct container 200 based on a position of the driven gear 410 detected by the second magnetism detection unit 450. When the control unit 510 determines that the amount of stored dusts is above a reference amount, the signal display unit 530 displays the dust emptying signal under the control of the control unit 510. Here, since the driven gear 410 is coupled to the first compressing member 220, it may be understood as that the position confirmation of the driven gear 410 is the confirmation of the rotation position of the first compressing member 220. Thus, since the first magnetism detection unit 440 detects the mounting of the dust container 200, it may be referred to as a "dust container detection unit". Also, since the second magnetism detection unit 450 confirms the position of the first compressing member 220, it may be referred to as a "position detection unit".

The signal displayed on the signal display unit 530 may be an aural signal or a visual signal or may be vibration directly transmitted to a user. A speaker, an LED, etc may be used as the signal display unit 530. The signal displayed on the signal display unit 530 may be set different from the dust emptying signal and the dust container non-mounting signal.

Figure 17:
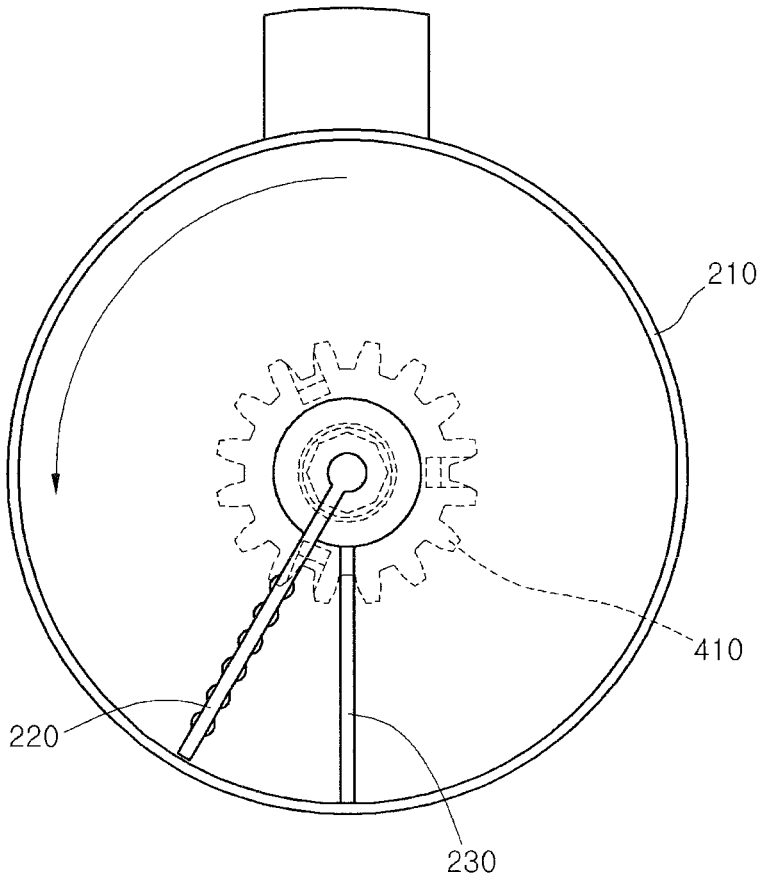
FIGS. 17 and 18 are views illustrating a position relationship between a magnetic member and a second magnetism detection unit in a state where a first compressing member for compressing dusts is adjacent to a side of a second compressing member.
Figure 18:
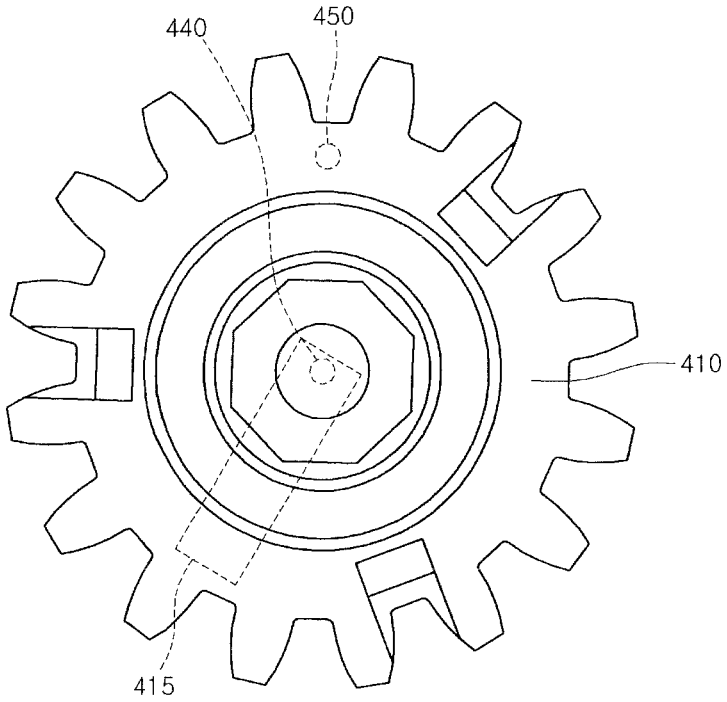
Figure 19:
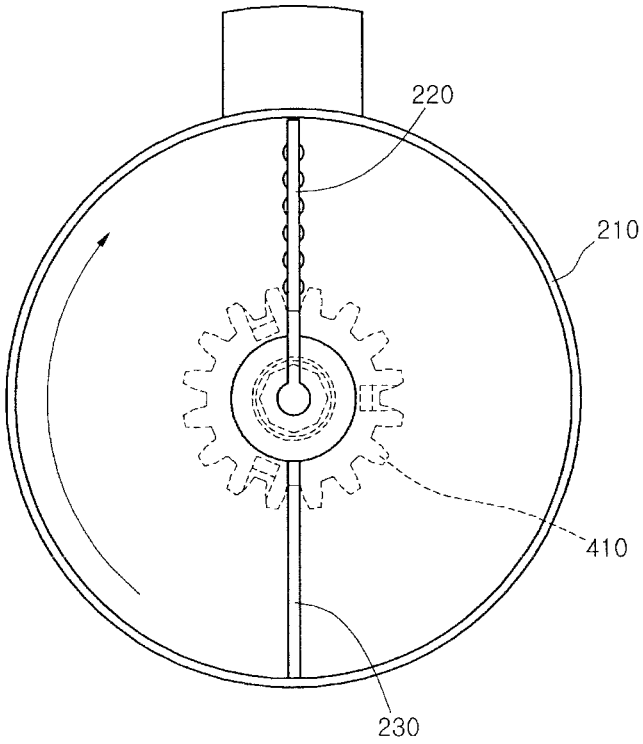
FIGS. 19 and 20 are views illustrating a position relationship between a magnetic member and a second magnetism detection unit in a state where a first compressing member and a second compressing member are disposed on one straight line.
Figure 20:
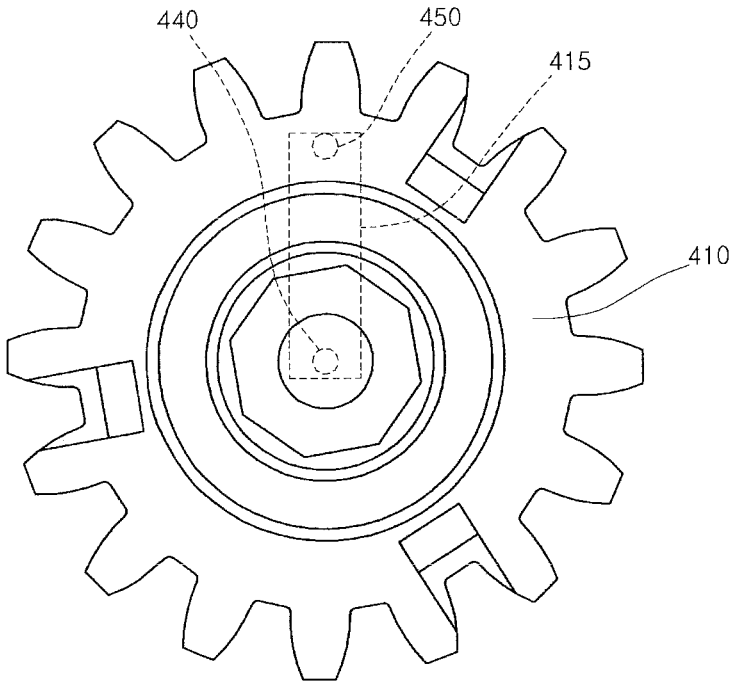
Figure 21:
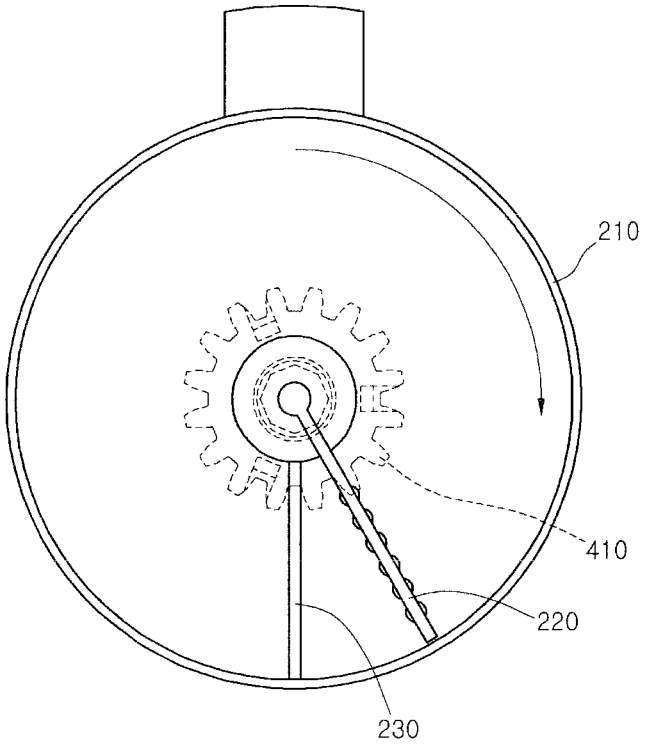
FIGS. 21 and 22 are views illustrating a position relationship between a magnetic member and a second magnetism detection unit in a state where a first compressing member is adjacent to the other side of a second compressing member.
Figure 22:
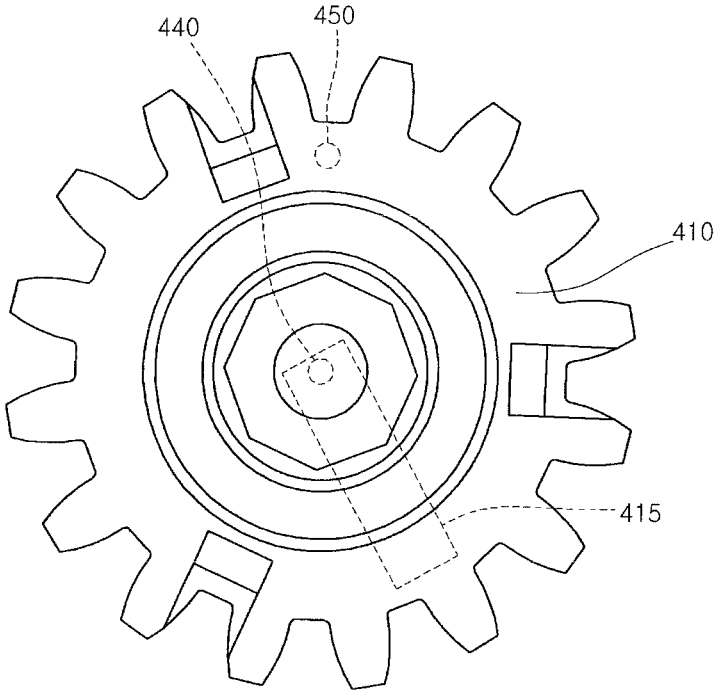

FIGS. 17 and 18 are views illustrating a position relationship between a magnetic member and a second magnetism detection unit in a state where a first compressing member for compressing dusts is adjacent to a side of a second compressing member. FIGS. 19 and 20 are views illustrating a position relationship between a magnetic member and a second magnetism detection unit in a state where a first compressing member and a second compressing member are disposed on one straight line. FIGS. 21 and 22 are views illustrating a position relationship between a magnetic member and a second magnetism detection unit in a state where a first compressing member is adjacent to the other side of a second compressing member.

As shown in FIGS. 17 to 22, in the current embodiment, when the first compressing member 220 and the second compressing member 230 are disposed on one straight line as rotated about 180 degrees with respect to the second compressing member 230, the magnetic member 415 is disposed directly above the second magnetism detection unit 450. Thus, the second magnetism detection unit 450 may detect magnetism of the magnetic member 415.

Here, the position of the first compressing member 220 illustrated in FIG. 19 that illustrates a state in which the second magnetism detection unit 450 detects the magnetism of the magnetic member 415 is called a "reference position"? for convenience of description. When the dusts accumulated within the dust container 200 is compressed while the first compressing member 220 is rotated in a count-clockwise direction with respect to the reference position as shown in FIG. 17, the magnetic member 415 is spaced from the second magnetism detection unit 450. Thus, the magnetism is not detected by the second magnetism detection unit 450. When the first compressing member 220 being rotated in the count-clockwise direction is not rotated any more, the first compressing member 220 is rotated in a clockwise direction. Thus, the first compressing member 220 passes through the reference position illustrated in FIG. 19 and is rotated toward a right side of the second compressing member 230 as shown in FIG. 21 to compress the dusts accumulated within the dust container 200. When the first compressing member 230 being rotated in the clockwise direction is not rotated any more, the compressing motor 570 is rotated in the count-clockwise direction to repeatedly perform the above-described processes, thereby compressing the dusts accumulated within the dust container 200.

Figure 23:
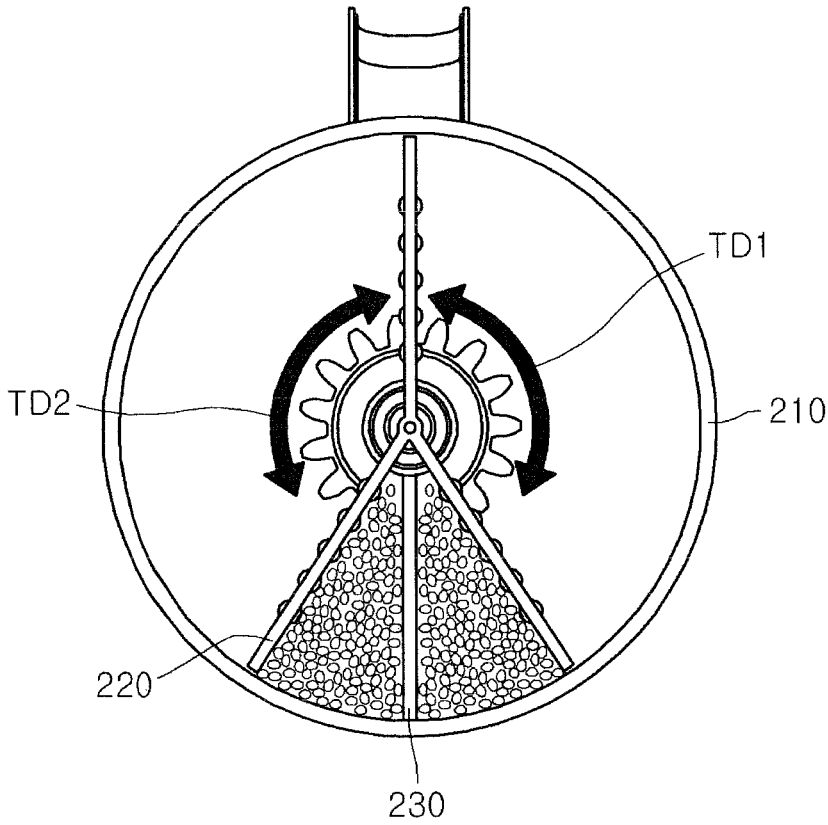
FIG. 23 is a view for explaining the whole rotation operation of the first compressing member of FIGS. 17 to 22.

FIG. 23 is a view for explaining the whole rotation operation of the first compressing member of FIGS. 17 to 22.

FIG. 23 illustrates a time TD1 for the first compressing member 220 to reach back to the reference position as rotated in the clockwise direction as shown in FIG. 21 from the reference position and a time TD2 for required for the first compressing member 220 to reach back to the reference position as rotated in counter-clockwise direction as shown in FIG. 17 from the reference position.

For convenience of description, the time TD1 is referred to as a first round trip time and the time TD2 is referred to as a second round trip time. In general, since the dust is spread evenly in the dust collection body 210, the first round trip time and the second round trip time are almost the same.

Figure 24:
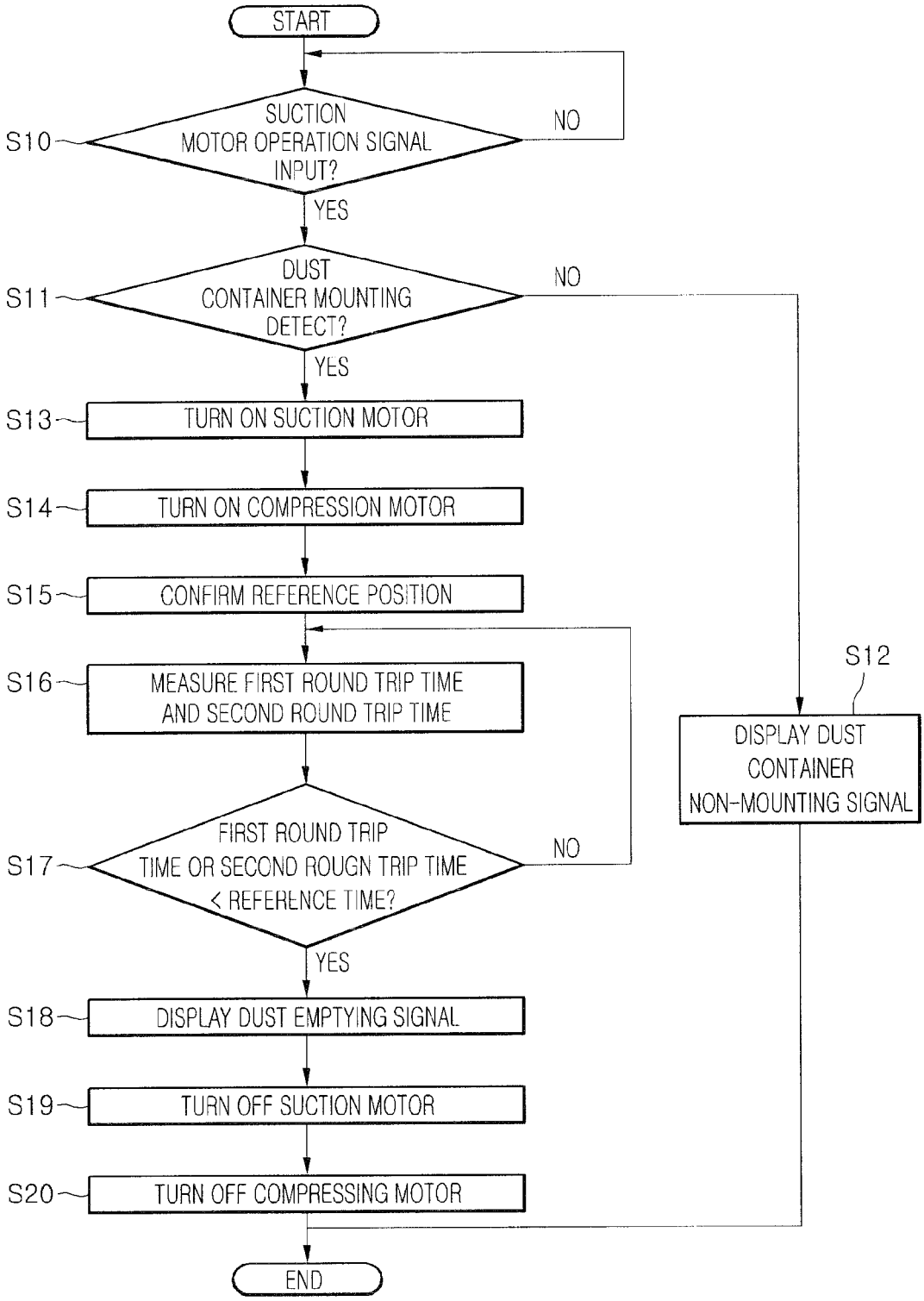
FIG. 24 is a flowchart illustrating a method of controlling a vacuum cleaner according to an embodiment.

FIG. 24 is a flowchart illustrating a method of controlling a vacuum cleaner according to an embodiment.

Referring to FIG. 24, in a state where an operation of a vacuum cleaner is stopped, whether a suction motor operation signal is inputted through an operation signal input unit 520 is determined in operation S10. If the suction motor operation signal is inputted, whether a dust container 200 is mounted is determined in operation S11. If the dust container 200 is not mounted, magnetism of a magnetic member 415 is not detected by a first magnetism detection unit 440. Thus, in operation S12, the control unit 510 controls a signal display unit 530 to display a dust container non-mounting signal on the signal display unit 530. As described above, when the suction motor operation signal is inputted in a state where the dust container 200 is not mounted, these states may be informed to the outside to prevent a suction motor from being unnecessarily operated.

On the other hand, if the magnetism is detected by the first magnetism detection unit 440 to determine that the dust container 200 is mounted, the control unit 510 operates a suction motor driver 540 so that the suction motor 550 is operated according to a suction power selected by a user in operation S13. Then, when the suction motor 550 is operated, the dusts are sucked through a suction nozzle by a suction force of the suction motor 550. Also, air sucked through the suction nozzle is introduced into a cleaner body 10. When the suction force is generated by the suction motor disposed inside the cleaner body 10, the air containing the dusts is introduced into the cleaner body 10. The air introduced into the cleaner body 10 is introduced into a distribution unit 300 and then is distributed into each of suction parts 123 and 124 of a dust separation device 100. The dusts separated by the dust separation device 100 are stored in the dust container 200. Since an effect of the dust separation device 100 is previously described, their detailed descriptions will be omitted.

In operation S14, the control unit 510 operates a compressing motor 570 for compressing the dusts stored in the dust container 200 in a process in which the dusts are stored in the dust container 200. Here, although the compressing motor 570 is operated after the suction motor 550 is operated in the current embodiment, the present disclosure is not limited thereto. For example, the suction motor 550 and the compressing motor 570 may be operated at the same time.

In operation S14, when the compressing motor 570 is operated, a driving gear 420 coupled to a rotating shaft of the compressing motor 570 is rotated. Then, when the driving gear 420 is rotated, a driven gear 410 engaged with the driving gear 420 is rotated. When the driven gear 410 is rotated, a first compressing member 220 is rotated toward a second compressing member 230 to compress the dusts. Here, in operation S15, the control unit 510 confirms whether the first compressing member 220 is disposed at a reference position. When the first compressing member 220 is disposed at the reference position, the magnetism of the magnetic member 415 is detected by the second magnetism detection unit 450. Thus, in operation S16, the control unit 510 determines a first round trip time TD1 or a second round trip time TD2 of the first compressing member 220 based on a time point at which the magnetism is detected first by the second magnetism detection unit 450. The control unit 510 includes a counter unit for measuring each of the first and second round trip times TD1 and TD2.

Here, the more an amount of dusts compressed within the dust container 200 by the first compressing member 220 and the second compressing member 230 is increased, the more the round trip rotation time in left and right directions becomes shortened. In operation S17, the control unit 510 determines the first round trip time TD1 and the second round trip time TD2 of the first compressing member 220 through the second magnetism detection unit 450 as well as determines whether the first round trip time TD1 and the second round trip time TD2 reach a predetermined reference time. Here, the predetermined reference time is a time set in the control unit 510 by a projector. It becomes the basis to determine that a predetermined amount or more of dusts is stored in the dust container 200. Although the method determining that the amount of dusts reaches a predetermined amount when one of the first round trip time TD1 and the second round trip time TD2 reaches the reference time in the current embodiment, however, it is possible that the basis of the determination is the case that both of the first round trip time TD1 and the second round trip time TD2 reach the reference time.

As a result of determination at the operation S17, in case where one of the first round trip time TD1 and the second round trip time TD2 is longer than the reference time, they return to the operation S16 and perform the former processes. On the contrary, in case where the first round trip time TD1 or the second round trip time TD2 reach the reference time, the control unit 510 controls the signal display unit 530 to display the dust emptying signal on the signal display unit 530 in operation S18. In operation S19, the control unit 510 turns off the suction motor 550 to prevent the dusts from being further sucked. Here, a reason forcibly stopping the suction motor 550 is because the dust suction efficiency is reduced and the suction motor 550 is overloaded if the suction operation for the dusts is continued forcibly when the amount of the dusts in the dust container exceeds the predetermined amount. Also, the control unit 510 turns off the compressing motor 570. In the current embodiment, the suction motor 550 and the compressing motor 570 may be stopped in order or at the same time.

As described above, in the current embodiment, since the dusts stored in the dust container are compressed by the first compressing member and the second compressing member, the dusts capacity storable in the dust container may be maximized.

According to the proposed embodiment, when the suction motor operation signal is inputted in a state where the dust container is not mounted, these states may be informed to the outside to prevent the suction motor or the compressing motor from being unnecessarily operated.

Also, since the dusts stored in the dust container are compressed to minimize a volume of the dusts, the dusts capacity storable in the dust container may be maximized.

Also, since the dust collection capacity of the dust container is maximized, an inconvenience in which the dusts stored in the dust container are frequently emptied may be removed.

Also, when the dusts are collected in the dust container beyond a predetermined amount, the dust emptying time may be displayed to allow the user to easily recognize the dust emptying time.

The invention claimed is:

1. A vacuum cleaner, comprising:

a cleaner body comprising a suction motor;

a dust separation device in communication with the cleaner body, the dust separation device separating dust from air drawn into the cleaner body by the suction motor;

a dust container separably mounted on the cleaner body, the dust container comprising a dust storage part storing the dust separated by the dust separation device;

a compressing member compressing the dust stored in the dust storage part;

a magnetic member seat part disposed at the dust container;

a magnetic member seated on the magnetic member seat part;

a cover coupled to a lower portion of the magnetic member seat part to cover the magnetic member; and a magnetism detection unit disposed at the cleaner body to detect magnetism of the magnetic member, wherein the cover comprises a guide rib to guide a seating position of the magnetic member and a plurality of hooks coupled to the magnetic member seat part, and wherein the magnetic member seat part comprises a plurality of hook coupling holes to which the plurality of hooks is respectively coupled, and a receiving part to receive the magnet member with the cover coupled to the magnetic member seat part.

2. The vacuum cleaner according to claim 1, wherein the cover further comprises a seat groove for seating the magnetic member, wherein a peripheral portion of the seat groove is bounded by the guide rib.

3. The vacuum cleaner according to claim 1, wherein the magnetic member extends in a radial direction from a center of the magnetic member seat part.

4. The vacuum cleaner according to claim 1, further comprising a driving device for operating the compressing member, wherein the driving device comprises a driving source and a power transmission part for transmitting a power of the driving source to the compressing member.

5. The vacuum cleaner according to claim 4, wherein the magnetic member seat part constitutes a portion of the power transmission part and is coupled to the compressing member.

6. The vacuum cleaner according to claim 5, wherein the driving device comprises a driving gear disposed within the cleaner body and a driven gear selectively engaged with the driving gear.

7. The vacuum cleaner according to claim 5, wherein the magnetic member is provided as a single unit, and the magnetism detection unit comprises a first magnetism detector for detecting magnetism at a first side of the magnetic member and a second magnetism detector for detecting magnetism at a second side of the magnetic member.

8. The vacuum cleaner according to claim 7, further comprising a control unit, wherein the control unit determines whether the dust container is mounted using a signal transmitted from the first magnetism detector and determines an amount of dust stored in the dust storage part using a signal transmitted from the second magnetism detector.

9. The vacuum cleaner according to claim 1, further comprising a signal display unit generating a signal when the dust container is not mounted.

10. The vacuum cleaner according to claim 1, wherein the dust separation device is provided separately from the dust container and is separably mounted on the cleaner body, and the dust separation device comprises a plurality of suction parts for sucking in air and dust.

* * * * *